United States Patent [19]

Wüsthof et al.

[11] Patent Number: 4,953,524

[45] Date of Patent: Sep. 4, 1990

[54] RADIAL PISTON ENGINE

[75] Inventors: Peter Wüsthof, Lohr, Fed. Rep. of Germany; Sinclair Cunningham, Kinghorn, United Kingdom

[73] Assignee: Mannesmann Rexroth GmbH, Lohr, Fed. Rep. of Germany

[21] Appl. No.: 395,720

[22] Filed: Aug. 18, 1989

[30] Foreign Application Priority Data

Aug. 18, 1988 [DE] Fed. Rep. of Germany ..... 3828131

[51] Int. Cl.[5] ..... F02B 57/00

[52] U.S. Cl. ..... 123/43 C; 123/55 AA

[58] Field of Search ..... 123/55 R, 55 A, 55 AA, 123/55 AB, 55 AC, 43 R, 43 A, 43 AA, 43 C, 195 R

[56] References Cited

U.S. PATENT DOCUMENTS

| | | | |
|---|---|---|---|
| 2,371,005 | 3/1945 | Wagers | 123/55 AA |
| 3,822,681 | 7/1974 | Townsend | 123/43 C |
| 3,885,533 | 5/1975 | Townsend | 123/43 C |
| 3,964,450 | 6/1976 | Lockshaw | 123/55 AA |
| 4,128,084 | 12/1978 | Sutherland | 123/55 AA |
| 4,334,506 | 6/1982 | Albert | 123/55 AA |
| 4,408,577 | 10/1983 | Killian | 123/55 AA |

FOREIGN PATENT DOCUMENTS

| | | | |
|---|---|---|---|
| 718647 | 3/1942 | Fed. Rep. of Germany | 123/55 AA |
| 3531632 | 3/1987 | Fed. Rep. of Germany . | |
| 557491 | 8/1923 | France | 123/55 AA |
| 810857 | 4/1937 | France | 123/55 AA |
| 179956 | 3/1923 | United Kingdom | 123/55 AA |

*Primary Examiner*—David A. Okonsky

*Attorney, Agent, or Firm*—Cushman, Darby & Cushman

[57] ABSTRACT

A radial piston engine comprising: a housing, an annular cam disk fixedly mounted in said housing, a cylinder block rotatably mounted about an axis with respect to said cam disk, a plurality of bores arranged in said cylinder block in a position radially with respect to said axis of rotation, a plurality of pistons respectively mounted in said bores, and cylindrical rollers for supporting said pistons on said cam disk, said rollers having axes which extend parallel to the axis of rotation of the cylinder block, and wherein said bores of said cylinder block which are adapted to receive and pistons are provided with recesses in the area of movement of said rollers, so as to receive sections of said rollers on both endfaces of said rollers.

6 Claims, 3 Drawing Sheets

10
11
11b
14
50
51
55
56
57
58
59
60
150
2
3
5
A 9
72
71
70
11
8
10
150
11b
51
55
56
57

RADIAL PISTON ENGINE

TECHNICAL FIELD

The Invention relates to a radial piston engine, particularly a radial piston motor of the type shown in German Patent 35 31 632.

BACKGROUND ART

German Patent 35 31 632 teaches a radial piston engine comprising a housing, an annular cam disk fixedly mounted in said housing, a cylinder block rotatably mounted about an axis and with respect to said cam disk, a plurality of bores arranged in said cylinder block radially with respect to said axis of rotation, a plurality of pistons respectively mounted in said bores, and cylindrical rollers for supporting said pistons on said cam disk, said rollers having axes which extend parallel to the axis of rotation of the cylinder block, and wherein said bores of said cylinder block which are adapted to receive said pistons are provided with recesses in the area of movement of said rollers, so as to receive sections of said rollers on both end faces of said rollers.

In said known radial piston engine the circumferential grooves require a certain depth, so as to allow an insertion of said rollers into said bores which are adapted to receive said pistons, while at the same time the rollers are guided sideways (on their side) at remaining or abuttment surfaces of the sideways arranged rotor or cylinder block wall. So as to achieve this goal, a relativly large depth is required for the circumferential grooves. This causes a reduction or weakening of the segment which remains between two piston bores. Such segments are necessary for supporting each piston. Said segments are subject to bending forces during operation due to the effect of the piston force. Thus the danger of a breakage exists, particularly a breakage due to extended periods of operation.

It is an object of the present invention to design a radial piston engine of the type mentioned above in such a manner that the disadvantages of known engines of this type are avoided. It is a particular object of the invention to design a radial piston engine of the above mentioned type in such a manner that the dangers of breakage in general or breakage due to extended periods of operation are avoided.

In accordance with the present invention a piston engine of the type mentioned above is provided with recesses formed in the following manner:

1. at the outer circumference of the rotor circumferential grooves are provided which cut through the piston bores in their radially outer area and
2. recessions (zones free of material) are provided radially inwardly with respect to the circumferential groove.

Due to the fact that the depth of the circumferential grooves is reduced by half with respect to the prior art, and in addition by providing in the area of the bores recessions (zones free of material), by milling, or, alternatively, by providing kidney-shaped openings, the desired insertion of the roller is maintained, wherein at the same time the supporting cross-section of the remaining segment in the cylinder block supporting the pistons remains sufficiently large.

In case said zones free of material are formed by milling, no great amount of work or cost is involved, in as much as modern machining centres provide for the additionally required milling operation without requiring a renewed clamping or mounting operation for the work piece. Only a small amount of material has to be removed, a fact which is beneficial with regard to the strength of the cylinder block.

BRIEF DESCRIPTION OF THE DRAWINGS

For a better understanding of the present invention reference may be made to the accompaning drawings in which:

FIG. 1 shows a radial piston engine of the prior art. A first half of the housing is refered to by reference numeral 1 and reference numeral 2 refers to a second housing half. Between said housing halves 1,2 the cam disk or cam ring 3 is arranged. By means of mounting screws 4 the two housing halves form together with the cam disk 3 a fixed unit. In the housing half 1 a shaft 5 is supported by means of bearings 6, 7. The housing side end 8 of the shaft 5 is designed as a multi wedge shaft and supports by means of a corresponding recess 9 the rotor 10. The rotor 10 is designed as a cylinder block and comprises about its circumference equally spaced bores 11 which are adapted to receive pistons 12. The pistons 12 are provided in their radially outer area or region with a recess for receiving a bearing dish 13 and the cylindrical roller 14. The rollers 14 are adapted to be supported by the curved path 17 of the cam disk 3. In the radially lower region of the piston 12 a circumferential groove is provided which is adapted to receive a piston ring as a sealing element. The piston chambers formed by said bores 12 are operatively connected via axially extending bores 21 with axially extending control bores 22, 23 of a stationary control sleeve 24 which is located in the housing half 2. The control sleeve 24 limits circumferencialy extending control spaces 25, 26 which are connected with ports for the pressure source and the tank, respectively (not shown in detail). Depending on the position of the bores or the piston chambers 11 with respect to the control bores, said chambers 11 are either connected with the pressure source or with the tank and thus a rotary moment is exerted onto the rotor 10. This moment is supplied by means of said multi wedge connection to the input shaft and output shaft 5, respectively.

Figures 2, 3, 4, 5:
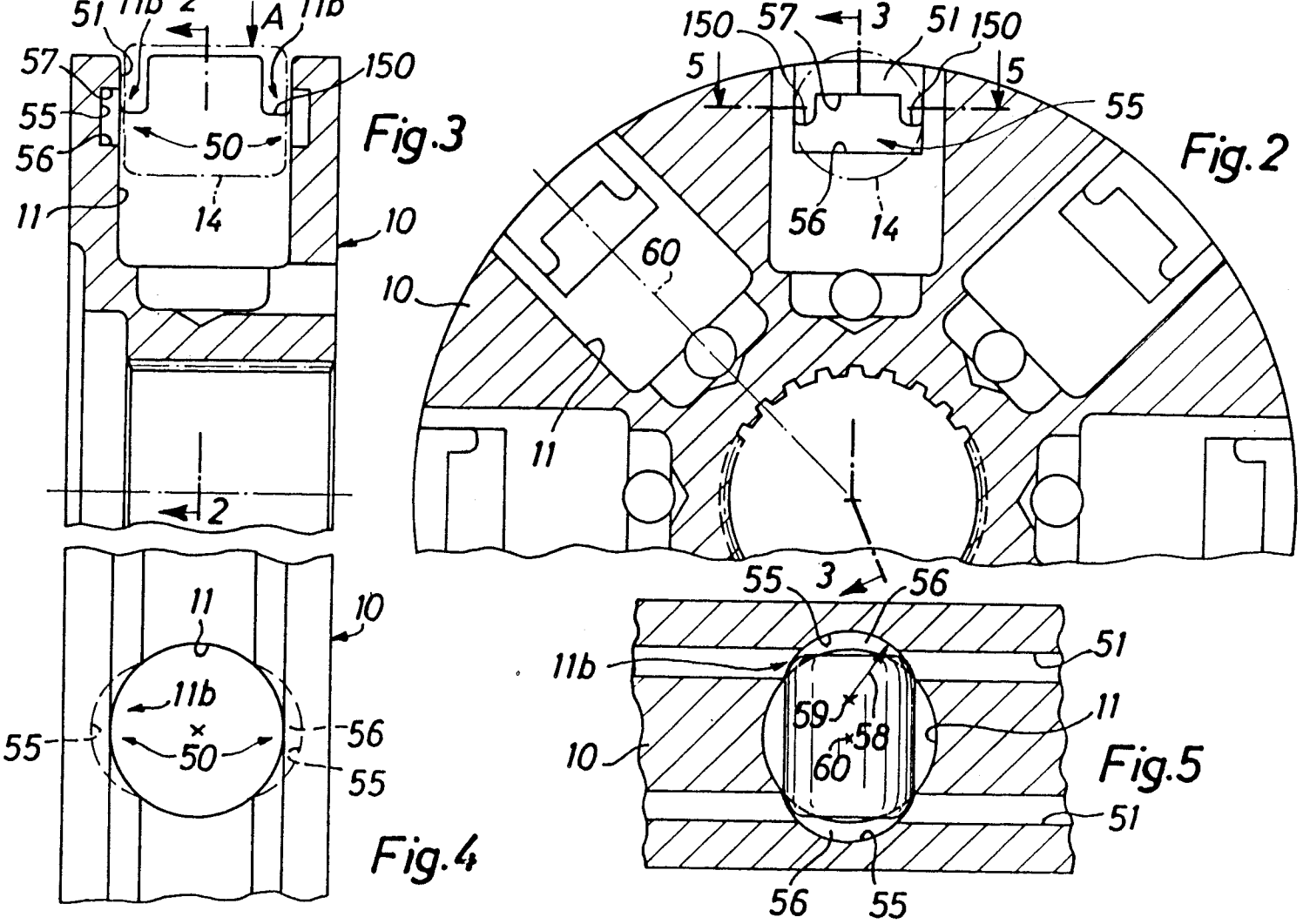
FIG. 2 is a sectional view along the longitudinal axis of a rotor in accordance with a first embodiment of the invention, said section is shown as extending along line 2—2 in FIG. 1.
FIG. 3 is partial sectional view along line 3—3 in FIG. 2.
FIG. 4 is a partial plan view of the rotor as seen in the direction of arrow A in FIG. 3.
FIG. 5 is a sectional view along line 5—5 in FIG. 2.

The radial piston engine of German Patent 35 31 632 comprises, as is shown in FIG. 3 to 5 of said German patent, four recesses 11*a* adapted to receive sections of the roller 14. Said recesses 11*a* are obtained in the known radial piston engine by the circumferentially extending grooves 15 at the rotor 10, and are consequently a part of the grooves. The grooves 15 are dimensioned such that the outer bordering walls of the grooves 15 provide at the same time actual guidance for the side surfaces of the rollers. The depth of insertion of the circumferencial grooves 15 can be reduced because the roller 14 can be inserted to some extent into the existing piston bore 11.

The present invention is directed to the design of the recesses 11*a*. In the embodiments of the present invention which will be described below, the recesses will be referred to the reference numeral 11*b* so as to distinguish them over said known recesses 11*a*. Initially, referring to FIGS. 2 through 6, a first embodiment of the invention will be described. Here again, as before, rotor 10 (see FIG. 2) comprises a plurality of bores 11 forming piston chambers. The pistons are not shown but are supported via rollers 14 (dashed lines) on a curved path or cam path 17 (not shown) like in FIG. 1.

Figure 1:
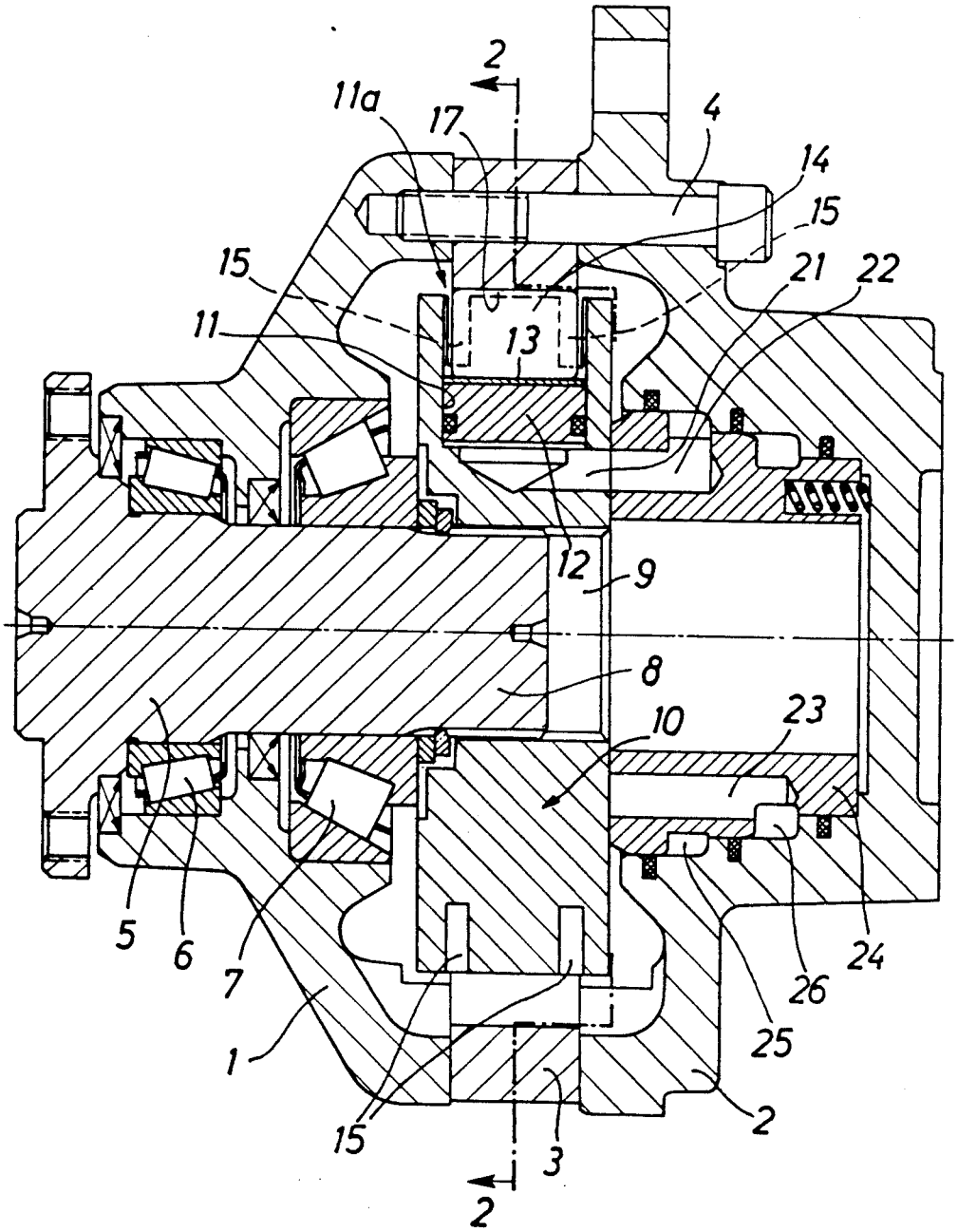
Fig.1 (PRIOR ART)
FIG. 1 is a sectional view along the longitudinal axis of a radial piston engine of German Patent 35 31 632.

Different from the prior art of FIG. 1, the recesses 11*b* are not only formed by the circumferencial grooves 15. In accordance with the invention, the recesses 11*b* are firstly formed by grooves 150 which extend circumferencially around the outer circumference of the rotor 10. Secondly, the recesses 11*b* are formed by recessions 50 or zones free of material. Said recessions 50 extend radially inwardly with respect to the circumferencial groove 150 and they are located in the area of each of said bores 11. The recessions 50 are thus not circumferentially arranged like the grooves 150 but, as stated, only in the area of the bores 11. Each of the circumferentially extending groove 150 is substantially less deep than it is known from the above mentioned prior art. This has the effect that the stability of the rotor is increased. For instance, the depth of groove 150 is only approximately half the depth of groove 15 of the prior art.

In the first embodiment of the invention the recession (zones free of material) 50 is provided within the area of the bore 11, i.e. a milled recess 50 (called milling recess 50 below) is provided. Said milling recess 50 is preferably located partially deeper than the appropriate circumferencial groove 150. Said milling recesses 50 are actually provided on both sides (see FIG. 4) so that the desired insertion of the roller 14 into the piston bore 11 is possible.

Above the the milling recess 50 remains a sufficiently large abuttment surface 51 which is located sideways and which serves for the sideways guidance of the roller 14. In accordance with a preferred manufacturing method a relatively large disk shaped milling tool is used, which can be radially inserted into the piston bore 11.

Specifically, the recess 11*b* is formed by the milling recess 50 which is offset outwardly with respect to the groove 150. The milling recess 50 comprises a sidewall surface 55 as well as a bottom surface 56 and an upper surface 57. The radius of milling is refered to by reference numeral 58 in FIG. 5 and the two center points 59 of milling are referred to by reference numeral 59 and they are offset with respect to the longitudinal axis 60 of the bore 11 in axial direction. The radius of milling 58 is selected such that the desired depth of insertion for roller 14 is obtained.

Figures 6, 7, 8, 9:
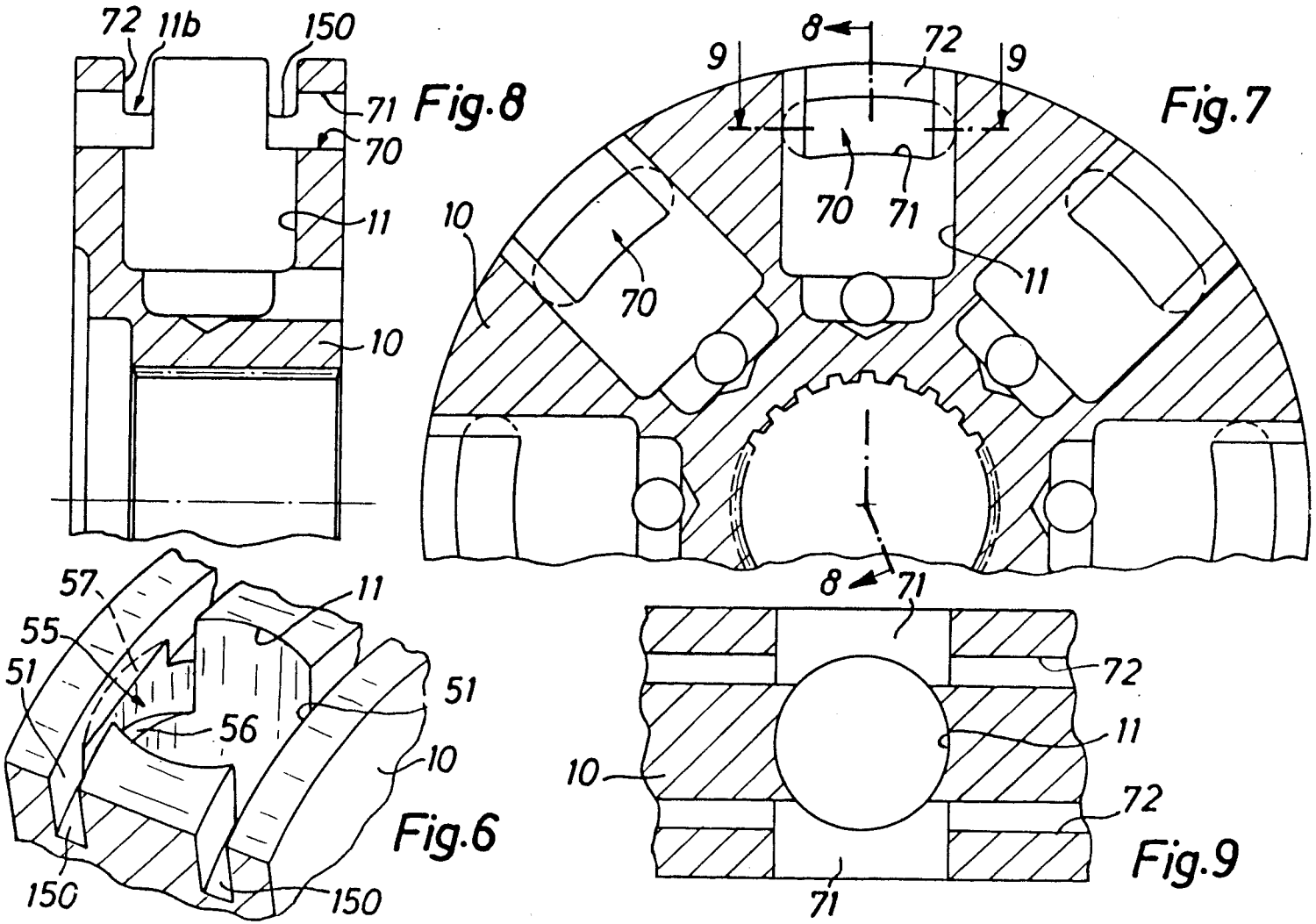
FIG. 6 is an isometric view of the bore of FIG. 4 as seen from the right front side and from above.
FIG. 7 is a sectional view similar to FIG. 2 showing a second embodiment of the invention.
FIG. 8 is a sectional view along line 8—8 FIG. 7.
FIG. 9 is a sectional view along line 9—9 in FIG. 7.

In the second embodiment shown in FIG. 7 through 9 the recesses 11*b* are formed like in the first embodiment by a groove 150 and in addition by a recession 70 (zone 70 free of material). This recession 70 has, in this embodiment, the form of a kidney-shaped opening 71. This opening 71 is formed in the cylinder block or rotor 11 from outwardly and from the side. The kidney-shaped openings 71 are formed in the area of the bores 11 such that the circumferencial grooves 150 are cut so as to provide for the desired recesses, such that the grooves 150 do not cut too deeply in radial direction into the rotor 11. Again, sufficiently large abuttment surfaces 72 are formed on the side to provide sideways guidance of the roller 14. Because of the symmetrical design it is clear that for each bore 11 each two oppositely located kidney-shaped openings 71 are provided. This is also true for the milling recesses 50 of the first embodiment.

We claim:

1. A radial piston engine comprising:

a housing, an annular cam disk fixedly mounted in said housing, a cylinder block rotatably mounted about an axis with respect to said cam disk, a plurality of bores arranged in said cylinder block in a position radially with respect to said axis of rotation, a plurality of pistons respectively mounted in said bores, and cylindrical rollers for supporting said pistons on said cam disk, said rollers having axes which extend parallel to the axis of rotation of the cylinder block, and wherein said bores of said cylinder block which are adapted to receive said pistons are provided with recesses in the area of movement of said rollers, so as to receive sections of said rollers on both end-faces of said rollers.

2. Radial piston engine according to claim 1, wherein the recesses are located within the area of each bore.

3. Radial piston engine according to claim 2, wherein the recesses are located partially deeper than a circumferential groove.

4. Radial piston engine according to claim 1, wherein the recesses are formed by milling.

5. Radial piston engine according to claim 1, wherein the recesses are formed by openings which are provided sideways from the outside.

6. Radial piston engine according to claim 1, wherein the recesses are formed approximately half by grooves and by half by the recesses.

* * * * *